United States Patent [19]

Hochstein

[11] Patent Number: 4,484,955

[45] Date of Patent: Nov. 27, 1984

[54] SHAPE MEMORY MATERIAL AND METHOD OF TREATING SAME

[76] Inventor: Peter A. Hochstein, 2966 River Valley Dr., Troy, Mich. 48098

[21] Appl. No.: 560,321

[22] Filed: Dec. 12, 1983

[51] Int. Cl.[3] ..... C21D 1/78; C22F 1/08; C22F 1/10

[52] U.S. Cl. ..... 148/11.5 R; 148/11.5 C; 148/11.5 N; 148/402

[58] Field of Search ..... 148/11.5 R, 11.5 N, 148/11.5 F, 402, 11.5 C

[56] References Cited

U.S. PATENT DOCUMENTS

| | | | |
|---|---|---|---|
| 3,558,369 | 1/1971 | Wang et al. | 148/11.5 R |
| 3,948,688 | 4/1976 | Clark | 148/11.5 R |
| 4,149,911 | 4/1979 | Clabburn | 148/11.5 R |
| 4,435,229 | 3/1984 | Johnson | 148/11.5 R |

*Primary Examiner*—W. Stallard
*Attorney, Agent, or Firm*—Harold W. Milton, Jr.

[57] ABSTRACT

A method of treating an integral piece of thermosensitive material which undergoes thermoelastic, martensitic phase transformation in response to heat to pass from a martensitic phase when at a temperature below a phase transformation temperature range and capable of a first high level of recoverable strain to a parent austenitic phase and memory shape when at a temperature above the phase transformation temperature range and capable of a second lower level of recoverable strain. The method is characterized by first cold working the material to a cold worked state comprising a disordered combination of martensitic and austenitic structures and then memory annealing a first portion of the integral piece of material to establish the martensitic and austenitic phases and the memory shape in the austenitic phase while retaining a second portion of the integral piece of material in the cold worked state and incapable of shape memory response. The piece of material is then mounted in a working environment by being supported and restrained in the second cold worked portion while the first annealed portion is free to pass back and forth between the martensitic and austenitic phases to produce useful work in response to heat.

10 Claims, 4 Drawing Figures

SHAPE MEMORY MATERIAL AND METHOD OF TREATING SAME

TECHNICAL FIELD

The subject invention relates to thermoelastic materials having a shape memory effect which are typically utilized in thermomotors, actuators, relays and a wide variety of other thermally-responsive transducers. Such materials include Nitinol or brasses of the Cu—Zn—Al family.

BACKGROUND OF THE INVENTION

Thermoelastic shape memory motor elements can consist of wire, ribbon, rod, coils, beams or other geometric shapes of a material such as Cu-Zn-Al or NiTi which undergo a change in shape, length or volume as a function of thermally and/or stress-induced phase changes. The most well known of these materials is Nitinol, and it has been used in thermomechanical motors and transducers of all sorts.

In heat engine applications where a Nitinol element, for example, is used to convert heat energy into mechanical work, the shape memory element is cooled to below a critical phase transformation temperature ($M_f$) where the alloy undergoes a crystalline phase transformation into a martensitic phase. This martensitic phase is mechanically weak, and is easily deformed (superplastically) by a relative low externally applied stress. Deformations on the order of three to eight percent strain are typical. When the strained motor element is now heated above the material's austenitic finish, temperature ($A_f$), the alloy transforms into its parent or austenitic phase with the attendant return of the element to its original length or shape.

Significant mechanical work may be performed by such shape memory materials as they recover strain in the austenitic phase. The cooling-straining and heating-strain recovery cycles may be repeated a great number of times if the maximum permissible stress and strain limits for the specific material are not exceeded. U.S. Pat. 4,197,709 describes the use of a stress-limiting system wherein the maximum permissible stress in a given shape memory element is automatically limited to a safe value. Such a stress limiter is only applicable to the whole motive shape memory element or group of elements; that is, only the total output strain is limited and not the local strain along the element.

In order to use the shape memory effect (SME) of a SME alloy to best advantage in a thermally activated transducer, the motor element must be given a shape memory anneal. This heat treatment establishes the memory shape that the element will assume when heated above the austenitic finish temperature ($A_f$). Above the $A_f$ temperature the SME alloy is transformed into the parent austenitic phase.

The annealing process is important because all SME materials known to date do not exhibit significant or useful SME behavior in the cold-worked state. The highly cold-worked state is due to the metallurgical forming processes employed in reducing an ingot or bar of SME alloy to useful shapes such as strip, sheet, wire, tubing, etc. These forming procedures, even with intervening annealing to prevent brittleness, yield SME materials with heavily deformed martensitic structures which do not deform superplastically and are unable to transform to the parent phase with ease.

Virtually, all existing procedures for obtaining useful SME response from rolled or drawn alloys involve heat treatment (annealing) at certain carefully controlled temperatures after the final reduction in area. For example, NiTi (Nitinol) exhibits excellent shape memory response when heat-treated (memory annealed) at between 300° C. to 600° C., depending on the desired $A_f$ temperature.

The as-drawn or as-rolled state which typically represents a last step reduction in area of five to twenty percent, is characterized by its high tensile yield strength and low elastic modulus. Careful repeated cold working of Nitinol, for example, has yielded material with tensile yield strengths in excess of 200,000 p.s.i. with an elastic modulus of about $4\times10^6$ p.s.i. while still in the martensitic phase. Such material makes excellent springs, and in fact can store significantly more energy than steel because of the eight-fold reduction in modulus of elasticity with no sacrifice in yield strength.

As used in existing shape memory effect (SME) transducers the element of SME material is annealed or heat-treated to include the whole length (La) of motor element. Typically, a long length of material is furnace-annealed, and suitable sections are then cut and mounted as required. The important point is that the full length of material, including the material held in the anchor or clamp zone, is capable of shape memory response. Starting at, for example, a temperature where the SME element is fully martensitic (below the $M_f$), the wire of recovered length La may be strained by an applied force (F) by $\Delta 1$ to a new length Ls. The actual strain $\Delta 1/La$ is, of course, chosen so that it does not exceed the maximum permissible strain (four to six percent for NiTi or Cu—Zn—Al) and full strain recovery is possible upon heating above $A_f$.

The SME element (in this case a wire) heats at a rate proportional to the temperature difference of the applied heat (Hi) and the temperature of the element at any given time. Other factors affecting heat transfer to the wire and the consequent rise in temperature of the wire are well known. Thermodynamics and heat transfer engineering clearly relate the rise in temperature of the SME wire element to the Reynolds number of the surrounding fluid, surface roughness of the wire, enthalpy of the medium, differential temperatures, sensible and latent specific heats, thermal conductivity and diffusivity and other more subtle parameters. Other than controlling the specific rate of temperature rise, all these other thermodynamic considerations do not materially affect the behavior of the SME element to a rise in temperature above the $A_f$ temperature of the SME alloy. Namely, when the $A_s$ temperature is reached, the martensitic phase in the alloy transforms to the parent austenitic phase with an attendant strain recovery ($\Delta 1$) to the original length (La). Work performed by the recovery strain may be extracted at the free end of the wire shown.

At the anchor (fixed) region of the wire, the SME material is buried within a structure consisting of the clamp, screw or similar mechanism. The rise in temperature of the SME material within this structure, and somewhat outboard of the actual attachment area, will lag in time with respect to the rest of the SME element. The reason for this is that direct contact with the heat transfer fluid is prevented at the attachment end(s). The added thermal mass of the anchoring mechanism prevents the SME element from uniformly heating along its full length in a simultaneous manner.

If the SME element is not required to perform any work, thereby keeping the stress in the element minimal, the effect of this uneven rise in element (wire) temperature is of little consequence. However, should the free end of the wire be constrained in any way during the shape recovery period ($A_S \rightarrow A_F$) in order to do mechanical work, the stress in the wire will rise to some value (normally controlled to a safe maximum) for the austenitic (parent) phase, typically 30 k.s.i. to 70 k.s.i. for Niti.

Now an interesting phenomenon is observed: the average strain in the element as the $A_s$ temperature is reached is, of course equal or less than the original $\Delta l$ strain which was introduced below $M_f$ (typically four percent). However, the local strain may be much higher. In fact, local strains may be great enough (over ten percent) to severely, plastically strain the SME element in a relatively small region, usually the attachment point where the temperature rise lags behind the rest of the element. The lag in temperature of the SME material at the attachment region is due to the simultaneous lagging in time of the transformation from the weak martensitic phase to the strong austenitic phase.

The area of the SME element which remains martensitic while the rest of the element is converting to austenite has an elastic modulus of nominally $3.5 \times 10^6$ p.s.i. compared to the $13 \times 10^6$ p.s.i. modulus of the austenitic region. Remembering that the stress in the element is nominally equal along its length (at least for an element of constant cross section), the lower modulus area must strain more (actually three times more) on a local basis. Since the stress required to strain the martensitic area of the SME element is only a fraction of the austenitic recovery stress, permanent plastic deformation in the cooler area results.

The "lagging" portion of a typical element is restricted to areas of attachment, so that even large plastic local strains affect a real length of only several millimeters. However, the nonrecovered strain, especially in physically short elements (in actuators for example) is significant, and can complicate practical applications. Often, the nonrecoverable strain resulting from uneven heating may be compensated for by slack takeup mechanisms; however, if the local strain is very high (over ten percent) local reduction in area of the element may result with the added problem of increased brittleness due to work hardening. Eventual breakage of SME elements results and most often at the points of attachment.

For mechanical testing purposes, a heated grip has been developed wherein the area of attachment is artificially kept at a temperature above $A_f$, so that the SME material cannot undergo excessive strain or breakage in or at the attachment area. The practical application of heated connections is somewhat limited; only certain heat engines could usefully incorporate such attachment schemes.

SUMMARY OF INVENTION

A method of heating an integral piece of temperature-sensitive material to undergo thermoelastic, martensitic phase transformation in response to heat to pass from a martensitic phase when at a temperature below a phase transformation temperature range and capable of a first high level strain to a parent austenitic phase and a memory shape when at a temperature above the phase transformation temperature range and capable of a second lower level of strain. The method is characterized by cold working the integral piece of material to a cold worked state comprising a disordered combination of martensitic and austenitic structures, and memory annealing a first portion of the integral piece of the material to establish the martensitic and austenitic phases and memory shape in the austenitic phase while retaining second portion of the integral piece of material in the cold worked state and incapable of shape memory response.

FIGURES IN THE DRAWINGS

Other advantages of the present invention will be readily appreciated as the same becomes better understood by reference to the following detailed description when considered in connection with the accompanying drawings wherein:

FIG. 1 is a side elevational view partially broken away in cross section of a shape memory element of the subject invention;

FIG. 2 is a schematic cross-sectional drawing showing a first embodiment for performing the method of the subject invention;

FIG. 3 is a schematic view showing a second method of performing the subject invention; and FIG. 4 is another embodiment for performing the subject invention .

DESCRIPTION OF THE DRAWINGS

An integral piece of temperature-sensitive material in the form of a wire as shown at 10. The wire 10 has one end clamped in position as the wire extends through an aperture in a retaining or support structure 12 into which a threaded fastener or screw 14 is disposed for engaging the wire 10 and clamping same in position.

The wire 10 is of a temperature-sensitive material or shape memory material and undergoes a thermoelastic, martensitic phase transformation in response to heat to pass from a martensitic phase when at a temperature below a phase transformation temperature range at which it is capable of a first high level strain $L_s$ to a parent austenitic phase and a memory shape l when at a temperature above the phase transformation range temperature capable of a second lower level of strain. In other words, when in the cold state below the phase transformation temperature, the wire 10 may be stretched by a force F an amount to increase in length as it is deformed but when subjected to heat so that its temperature rises above the phase transformation temperature it returns to its memory shape or shortened length l. As will be appreciated, the force F may be applied through various different mechanisms such as clamps reacting with cams or levers or the like.

The method is characterized by first cold working the integral piece of material such as by drawing a large rod into a wire 10 in a cold worked state comprising a disordered combination of martensitic and austenitic structure at which the material exhibits insignificant shape memory characteristics. Thereafter, the material is memory annealed by annealing a first portion of the length of the integral piece of wire to establish the martensitic and austenitic phases and memory shape in the austenitic phase while retaining a second portion of the integral piece of wire in the cold worked state which is incapable of shape memory response.

Figure 2:
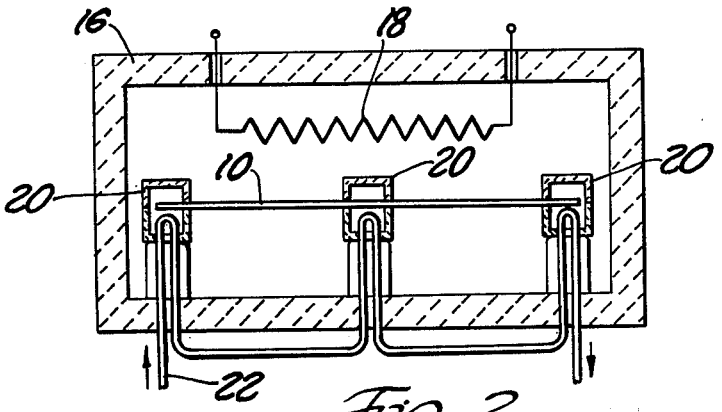

One embodiment of the invention is illustrated in FIG. 2 which shows an electric furnace 16 having an electrical heating element 18 disposed within the furnace enclosure. A shape memory element 10 is placed within the furnace and engaged by clamps 20. The clamps 20 are heat-insulated cooling clamps through which liquid coolant is circulated by the lines 22 for maintaining the portions of the lengths of wire 10 within the clamps 20 below the critical annealing temperature. Consequently, the first portions of the element 10 extending between the clamps 20 is annealed by being subjected to an external heat source 18 within the furnace 16 to be heated above the critical annealing temperature while the clamps 20 shield the second portions of the wire element 10 within the clamps from the heat of the heat source 18. The clamps 20 define heat-insulating enclosures.

Figure 3:
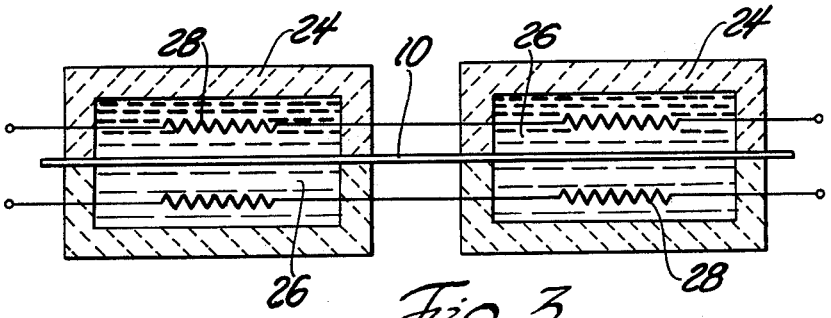

FIG. 3 shows an alternative embodiment wherein the shape memory element in the form of an integral length of wire 10 extends through thermal insulating enclosures 24 which enclose a heat-conducting liquid 26. The enclosures 24 may be divided in half so as to be pushed into clamping engagement with one another to clamp the elements 10 therebetween whereby only the first portions of the elements 10 which extend within the liquid baths 26 are heated above the critical annealing temperature. The liquid baths 26 may be heated by electrical resistant heaters 28.

Figure 4:
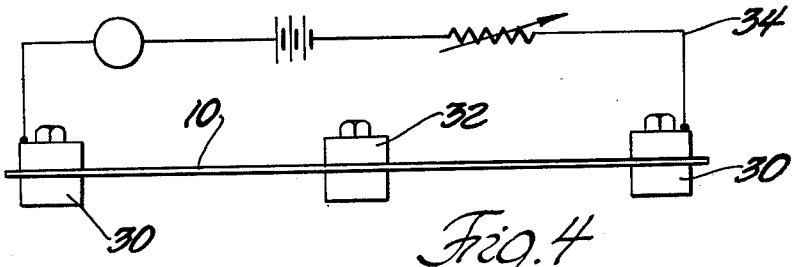

Yet another embodiment is illustrated in FIG. 4 wherein the shape memory element 10 extends through a plurality of electrically and thermally conductive clamps 30 and 32. An electrical circuit 34 provides for electrical current flow to the clamps 30 and through the wire 10. The second portions of the wire 10 are engaged by the clamps 30 with the clamps 30 having sufficient electrical and thermal conductivity to retain the second portions of the wire 10 disposed therein below the critical annealing temperature. In other words, only the first portions of the wire 10 extending between the clamps 30 and 32 is heated resistantly by electrical current passing therethrough sufficiently to rise above the critical annealing temperature. The middle clamping block 32 is a heat sink clamp which prevents the wire 10 extending therethrough from being heated above the critical annealing temperature.

Figure 1:
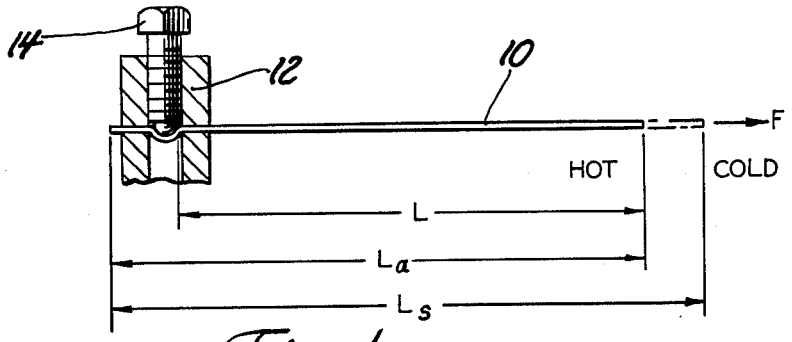

The resulting annealed length of wire may be supported in a working environment as illustrated in FIG. 1 so as to pass back and forth between the martensitic and austenitic phases in response to temperature changes through the phase transformation temperature by restraining the piece of wire along the second portion thereof within the clamp assembly 12 and 14 while leaving the first portion or length of wire 10 free to deform to its extended length $L_s$ in the martensitic phase and return to its memory shape length l in the austenitic phase. As suggested above, the outward or righthand end of the wire 10 in FIG. 1 may also be prevented from being annealed to render it incapable of shape memory whereby it may be clamped to a suitable work deriving mechanism.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

I claim:

1. A method of treating an integral piece of temperature-sensitive material to undergo thermoelastic, martensitic phase transformation in response to heat to pass from a martensitic phase when at a temperature below a phase transformation temperature range and capable of a first high level of recoverable strain to a parent austenitic phase and a memory shape when at a temperature above the phase transformation temperature range and capable of a second lower level of recoverable strain, said method characterized by cold working the integral piece of material to a cold worked state comprising a disordered combination of martensitic and austenitic structure, and memory annealing a first portion of the integral piece of material to establish the martensitic and austenitic phases and the memory shape in the austenitic phase while retaining a second portion of the integral piece of material in the cold worked state and incapable of shape memory response.

2. A method as set forth in claim 1 further characterized by supporting said integral piece of material in a working environment to pass back and forth between said martensitic and austenitic phases in response to temperature changes through the phase transformation temperature range by restraining said piece at said second portion while leaving said first portion free to deform to the martensitic phase and return to its memory shape in the austenitic phase.

3. A method as set forth in claim 1 further characterized by annealing the first portion by subjecting the material to an external heat source to heat the first portion to the critical annealing temperature while shielding the second portion from the heat of the heat source.

4. A method as set forth in claim 3 further characterized by shielding the second portion by placing the second portion in heat-insulating enclosures.

5. A method as set forth in claim 4 further characterized by subjecting the first portion to an external heat source by placing the first portion in a heated liquid bath.

6. A method as set forth in claim 1 further characterized by annealing the first portion by passing electrical current through said first and second portions while engaging the second portion with a material having sufficient electrical and thermal conductivity to retain the second portion below the critical annealing temperature.

7. An integral piece of temperature-sensitive material comprising a first portion which undergoes thermoelastic, martensitic phase transformation in response to heat to pass from a martensitic phase when at a temperature below a phase transformation temperature range and capable of a first high level of recoverable strain to a parent austenitic parent phase and a memory shape when at a temperature above the phase transformation temperature range and capable of a second lower level of recoverable strain, and a second portion integral with said first portion and incapable of shape memory response when heated from below the phase transformation temperature range to a temperature above the phase transformation temperature range.

8. An integral piece of material as set forth in claim 7 further characterized by support means engaging said second portion of said piece of material for restraining said second portion while leaving said first portion free to deform to the martensitic phase and return to its memory shape in the austenitic phase.

9. An integral piece of material as set forth in claim 8 further characterized by said piece being an elongated length of material.

10. An integral piece of material as set forth in claim 9 further characterized by said elongated length being a wire.

* * * * *